United States Patent [19]

Meyer

[11] 3,942,489

[45] Mar. 9, 1976

[54] TWO-CYCLE PISTON-CYLINDER COMBINATION

[75] Inventor: James A. Meyer, Oshkosh, Wis.

[73] Assignee: Brunswick Corporation, Skokie, Ill.

[22] Filed: Apr. 23, 1974

[21] Appl. No.: 463,270

[52] U.S. Cl. ..... 123/73 PP; 123/73 C; 123/193 CP

[51] Int. Cl.[2] ..... F02B 33/07

[58] Field of Search ..... 123/73 PP, 73 SP, 193 C, 123/193 CP, 65 A, 73 R, 73 C

[56] References Cited

UNITED STATES PATENTS

| | | | |
|---|---|---|---|
| 2,189,357 | 2/1940 | Cull | 123/65 A |
| 2,440,645 | 4/1948 | Byk et al. | 123/193 C |
| 3,374,776 | 3/1968 | Hooper | 123/73 PP |
| 3,411,289 | 11/1968 | Antonsen et al. | 123/65 PD |

FOREIGN PATENTS OR APPLICATIONS

| | | | |
|---|---|---|---|
| 918,666 | 8/1954 | Germany | 123/73 A |
| 672,418 | 2/1939 | Germany | 123/73 A |
| 539,095 | 2/1956 | Italy | 123/73 A |
| 415,322 | 8/1934 | United Kingdom | 123/193 P |

*Primary Examiner*—Wendell E. Burns
*Assistant Examiner*—David D. Reynolds
*Attorney, Agent, or Firm*—William G. Lawler, Jr.

[57] ABSTRACT

The invention is an improved piston and cylinder arrangement for a loop charged two-stroke engine wherein all input passages are open channels in the cylinder wall and the top annular edge of the piston is rounded. The rounded edge on the piston cooperates with the described scavenging and input passages to reduce drag and, cause the incoming charge to flow more horizontally over the piston head; thereby improving scavenging and volumetric efficiency.

4 Claims, 8 Drawing Figures

ROUND EDGE PISTON

12" $H_2O$ PRESSURE DROP

44 AMPERES TO FAN AT CONSTANT VOLTAGE "C"

SHARP EDGE PISTON

12" $H_2O$ PRESSURE DROP

41 AMPERES TO FAN AT CONSTANT VOLTAGE "C"

TWO-CYCLE PISTON-CYLINDER COMBINATION

BACKGROUND OF THE INVENTION

The invention is an improvement in the fuel-air charging system for a loop charged two-stroke engine typical of those used in outboard motors. Such systems usually include at least two main input transfer passages and one or more boost passages. Over the years much effort has gone into improving scavenging in these engines by either enlarging, multiplying or changing the shape of such passages as well as the pistons and combustion chambers to achieve a better flow of fresh charge into the engine and thereby gain more power and increased efficiency. An example of this effort in regard to cross-charged engines is U.S. Pat. No. 3,494,335 issued to H. R. E. Meier in 1968.

As in all well developed arts, there is a continuing effort not only to improve performance but also to simplify design and develop methods of manufacture to reduce cost. This invention is a step forward in each of these areas as it teaches a highly efficient cylinder and piston combination designed specifically to be compatible with high pressure die casting of aluminum engine cylinder blocks.

One problem encountered in designing a cylinder of the type described herein, where the input passages are channels in the cylinder wall, is how to direct at least a portion of the incoming charge across the face of the piston — as well as up into the combustion chamber — and thereby more effectively scavenge the burned charge. In the prior art this problem has been solved typically by forming the input passage within the cylinder block which provided lateral room for the passage to be curved from upright to horizontal before discharging into the cylinder. This cannot be done with passages open to the cylinder, consequently, prior to the invention, performancce was sacrificed to gain the cost advantage of this latter construction. The piston and cylinder design of the invention overcomes this deficiency while preserving the economy of construction.

SUMMARY OF THE PRESENT INVENTION

Basically the invention comprises a piston for a cylinder of a loop charged two-stroke engine having its top annular edge beveled or curved, rather than sharp as in the prior art, at least in those portions of its circumference which overlap the input passages of the cylinder; and the combination of said piston and a cylinder construction where said input passages are open channels which may be formed in the cylinder walls during high pressure die casting of the engine block.

The primary advantage of the piston of the invention is that, in the environment of input passages described, it significantly improves scavenging of the spent charge in the combustion chamber by the incoming fuel-air charge and thereby increases volumetric efficiency of the engine at all speeds, but particularly at low rpm.

A further advantage of the invention is that it teaches a completely die castable cylinder structure that has input flow characteristics comparable to those of cylinders having input passages outside the cylinder walls, which cylinders are much more difficult and expensive to produce.

Another advantage of the cylinder of the invention is that it is more compact than cylinders having input ports that course through the cylinder block, so that an engine constructed according to the teaching herein will be smaller and lighter than those of prior design and yet produce as much or more horsepower per pound.

Other objectives, advantages, and various further features of novelty and invention will be pointed out or will occur to those skilled in the art from a reading of the following specification in conjunction with the accompanying drawings.

FIG. *7a* is a Jante plot of simulated scavenging/charging flow into a cylinder of the invention with the piston of the invention at bottom dead center.

FIG. *7b* is a Jante plot of the same cylinder as that of FIG. *7a* but with a prior art piston having a sharp upper annular edge so positioned within the cylinder.

DETAILED DESCRIPTION OF THE PREFERRED EMBODIMENT

Figure 1:
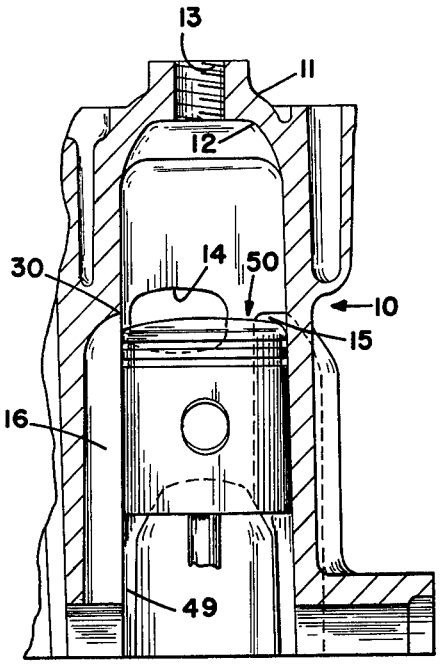
FIG. 1 is a vertical cross-sectional view of a piston and cylinder of the invention taken along line 1—1 of FIG. 2.
Figure 2:
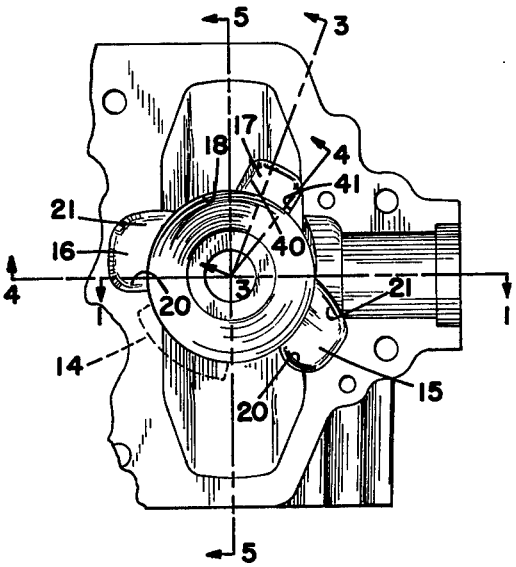
FIG. 2 is a bottom view of a cylinder of the invention.

Referring now to FIGS. 1 and 2, the cylinder block 10 includes the cylinder head 11 forming the combustion chamber 12 and providing an aperture 13 for a spark plug. Two charge input passages 15 and 16, a boost passage 17 and an exhaust port 14 are cast into the inner cylinder wall 18.

Figure 4:
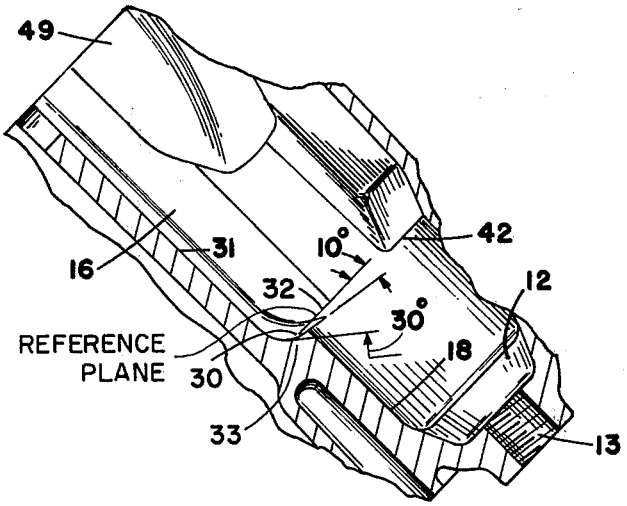
FIG. 4 is a vertical sectional view of a charging passage of the invention taken along line 4—4 of FIG. 2.

Referring to FIGS. 2 and 4, the input passages 15 and 16 are open their entire length through the cylinder wall 18 so that they comprise open channels in the cylinder wall. The side walls 20 and 21 of each input passage are substantially parallel to each other and to a vertical plane forming an angle of 58° with a diameter of the cylinder which bisects the exhaust port 14, and are located radially so that their respective longitudinal bisecting planes intersect in an area substantially equidistant from the center of the cylinder and the center of the open side of the boost passage 17.

Figure 5:
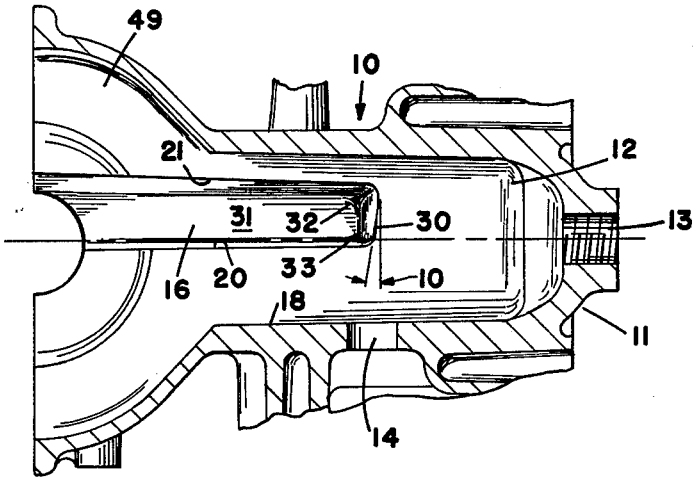
FIG. 5 is a vertical sectional view taken along line 5—5 of FIG. 2 illustrating a charging passage of the invention.

Referring to FIGS. 4 and 5, the top edge 30 of each charge input passage i.e. the line along which the top of the passage intersects the cylinder wall, slopes circumferentially upwardly as it progresses away from the exhaust port 14 at an angle of 10° to a lateral plane perpendicular to the longitudinal axis of the cylinder. The outer wall 31 of each input passage intersects the cylinder wall 18 at angles progressing from 10° upwardly from said lateral plane at its corner 32 most remote from the exhaust port 14, to 30° at its corner 33 nearest the exhaust port. This angulation and curvature result from insertion of a core having a constant radius at its upper extremity into the wall of the cylinder. This shape of the core facilitates die casting of the cylinder block. All of the walls of the input and boost passages are tapered to facilitate withdrawal of cores used in the casting of the cylinder block 10.

Figure 3:
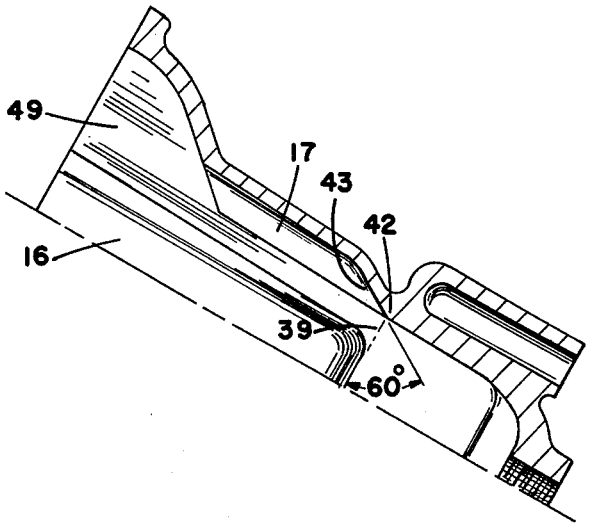
FIG. 3 is a vertical cross-sectional view of the boost passage of the cylinder of the invention taken along line 3—3 of FIG. 2.

Referring to FIGS. 2, 3 and 4, the boost passage 17 is located diametrically across from the exhaust port 14, with side walls 40 and 41 generally parallel to each other and to a vertical plane bisecting the cylinder 10 and the boost passage 17. The top edge 42 of the boost passage 17 falls on a circumference 39 of the cylinder 10, and the outer wall 43 of the passage 17 intersects a lateral plane through that circumference at a constant angle of approximately 60°.

The top edge 42 of the boost passage 17 and the top edges 30 of the input passages are in general alignment with the circumference of the cylinder bisecting the exhaust port 14, except for the 10° slope of the edges 30. Both the input and boost passages extend fully into the crankcase section 49 of the engine where the input fuel-air charge is compressed in the usual manner of operation of a two-cycle engine.

Figure 6:
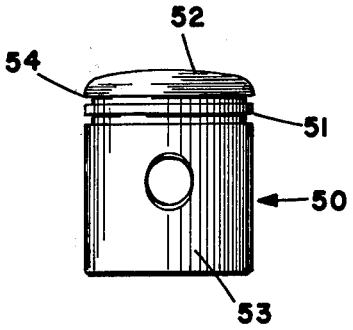
FIG. 6 is a front view of a piston of the invention.
Figure 7A:
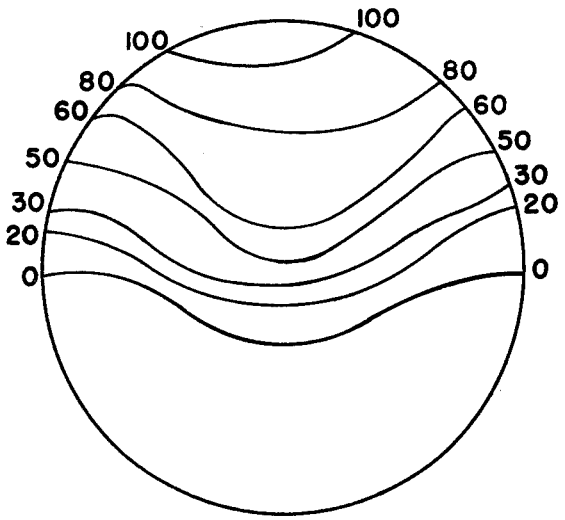
Figure 7B:
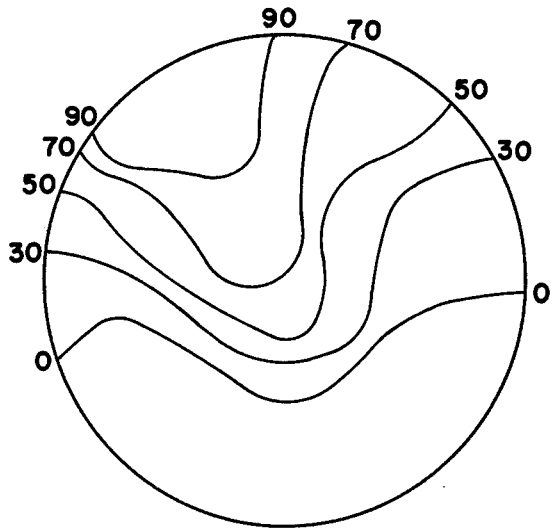

Referring to FIG. 6, the piston 50 of the invention may have annular grooves 51 for piston rings of the usual type which ride in fixed position therein. In the illustrated embodiment, the top face 52 of the piston is domed slightly to conform to combustion chamber design; however, such doming is not required to realize the advantages of the invention.

One particularly novel aspect of the invention is rounding of the piston side wall 53 into the piston face 52. The rounding need not be of a particular radius but should smoothly join the side wall 53 and the face 52 with a generous curve tongent to both surfaces 52 and 53 at its points of intersection therewith. In one configuration of the preferred embodiment, a piston of 1.55 in. diameter very successfully performed with such curvature commencing at the top edge 54 of the upper ring groove 51 and extending upwardly through a vertical use of approximately 0.110 in. where it joined the slightly domed face 52 of the piston. Although the inventor has not run studies to determine if the exact nature of this curvature can be correlated with the curvature of the outer walls 31 of the input passages to determine an optimum configuration, it is possible that such a relationship may be determined. It is speculated that even a simple beveling of the piston edge would show some improvement in the flow characteristic of the cylinder, but not so great as that achieved with the rounding described above.

Note that in applying known art to the design of an engine incorporating the invention, i.e. decision on input and exhaust port spacing to provide desired performance over a selected range of rpm, the timing edge of the piston is that point where the curved top edge of the piston breaks away from the cylinder wall 18 and not the highest lateral projection of the piston.

FIGS. *7a* and *7b* are flow diagrams which illustrate in feet-per-second the velocities of incoming charge of various points within a selected plane within the above described cylinder. This method of evaluating flow is described in paper no. −680468 authored by Alfred Jante and published by the Society of Automotive Engineers in May 1968, and consists essentially of indexing an array of pressure sensing tubes across the cylinder while a constant pressure drop is maintained across the cylinder. Efficiency is indicated not only by the shape of the pattern and the flow velocities achieved, but also by the energy required to drive the fan to maintain a selected pressure drop (12 inches $H_2O$ in this instance) through the cylinder. The energy required to maintain this 12 inches $H_2O$ drop through the cylinder in the drawings is indicated by power input to the fan; e.g. ampere flow at constant voltage, as indicated at the bottom of FIGS. *7a* and *7b.*

The figures compare the performance of a prior art piston with a sharp annular edge, FIG. *7b*, with the performance of a piston of the invention, FIG. *7a* when within the same cylinder described herein. In both instances the piston was at bottom dead center. A comparison of these two figures show that when the sharp annular edge of the piston is changed to a curved surface as taught herein, two things change:

1. The incoming charge moves in a more even front across the cylinder (a pattern found by experience and acknowledged in the art to be most effective), and 2. More energy is required to maintain the 12 inches $H_2O$ pressure drop across the cylinder with the curved edge piston, indicating less flow resistance with the improved piston to the incoming charge.

Both changes indicate an increase in scavenging efficiency.

The structure taught herein is adaptable to a die cast cylinder block of a hypereutectic silicon aluminum base alloy wherein the cylinder surface is treated as described in U.S. Pat. No. Re 27,081 assigned to Reynolds Metals Company, or a chromium plated aluminum cylinder, in either case to be used in conjunction with a compatible piston material.

It is significant to note that the pressure pattern of my improved cylinder, illustrated in FIG. *7a*, compares very favorably with patterns of engines having input passages curving through the cylinder block, yet is achieved with a more simplified and inexpensive structure.

While the principles of the invention have been described in connection with the above specific apparatus, it is to be clearly understood that this description is made only by way of example and not as a limitation to the scope of the invention.

I claim:

1. A two-cycle internal combustion engine comprising a die castable cylinder block including a crankcase, a cylinder having a head and a cylinder wall extending from said crankcase to said head and a piston adapted for reciprocal movement within said cylinder, an exhaust port through said cylinder wall and a plurality of charge input passages extending from said crankcase into said cylinder, said input passages each comprising an open channel in said cylinder wall, each such channel having wall tapering from said crankcase toward said cylinder head to facilitate withdrawal of casting cores from said block, and wherein one of said passages includes an outer wall 31 portions of which intersect the side wall 18 of the cylinder at acute angles to a lateral plane perpendicular to the axis of the cylinder, said angles decreasing in proportion to the distance of the relevant portion of said outer wall 18 from said exhaust port.

2. The device of claim 1 wherein said acute angles of intersection progressively decrease from apporximately 30° at the point nearest the exhaust port to approximately 10° at the point most remote from the exhaust port.

3. The device of claim 1 wherein the piston reciprocally mounted within said cylinder comprises a side wall, a face and a surface joining adjacent edge portions of said side wall and face, said surface curving upwardly away from said side wall and inwardly toward the center of said piston.

4. The device of claim 3 wherein said joining surface is convex and tangent to said side wall and face at juncture therewith.

* * * * *